US006489869B2

(12) United States Patent
Breitlow-Hertzfeldt et al.

(10) Patent No.: US 6,489,869 B2
(45) Date of Patent: Dec. 3, 2002

(54) ELECTRICAL COMPONENT AND PROCESS FOR THE MANUFACTURE THEREOF

(76) Inventors: Juergen Breitlow-Hertzfeldt, Freienwalder Strasse 7A, 13055 Berlin (DE); Ralf Hoffmann, Breitungerweg 31A, 12349 Berlin (DE)

( * ) Notice: Subject to any disclaimer, the term of this patent is extended or adjusted under 35 U.S.C. 154(b) by 0 days.

(21) Appl. No.: 09/795,942

(22) Filed: Feb. 28, 2001

(65) Prior Publication Data

US 2002/0014936 A1 Feb. 7, 2002

(30) Foreign Application Priority Data

Mar. 8, 2000 (EP) ..... 00104952

(51) Int. Cl.[7] ..... H01H 51/34

(52) U.S. Cl. ..... 335/90; 335/104; 335/105; 335/157

(58) Field of Search ..... 335/78–86, 90, 335/104, 105, 157, 193; 439/810–814

(56) References Cited

U.S. PATENT DOCUMENTS

| | | | | | |
|---|---|---|---|---|---|
| RE26,361 | E | * | 3/1968 | Mooney et al. | 335/90 |
| 4,933,655 | A | * | 6/1990 | Matsubara | 335/205 |
| 5,821,457 | A | * | 10/1998 | Mosley et al. | 174/52.4 |
| 5,949,313 | A | * | 9/1999 | Aoki et al. | 335/78 |
| 6,246,021 | B1 | * | 6/2001 | Thilker et al. | 335/46 |

* cited by examiner

*Primary Examiner*—Lincoln Donovan

(57) ABSTRACT

An electrical component having a functional unit which is secured to a header and which generates or is sensitive to sound, and having terminal elements which are mechanically secured to the header and electrically and acoustically coupled to the functional unit and which project through holes in the header onto the side of the header remote from the functional unit and which have a modulus of elasticity of $E_A$>50 MPa, in which the terminal elements are partially encased in a viskoelastic material having a modulus of elasticity of $E_W$<10 MPa. By encasing the terminal elements in a viskoelastic material, effective sound-damping can be produced. Furthermore, the invention relates to a process for manufacturing the component.

7 Claims, 1 Drawing Sheet

ELECTRICAL COMPONENT AND PROCESS FOR THE MANUFACTURE THEREOF

BACKGROUND OF THE INVENTION

The invention relates to an electrical component having a functional unit which is secured to a header and which generates or is sensitive to sound, and having terminal elements which are electrically and acoustically coupled to the functional unit and which project through holes in the header onto the side of the header remote from the functional unit, whereby the functional unit is acoustically isolated.

DESCRIPTION OF THE PRIOR ART

Electrical components of the type mentioned at the outset, which form a relay and in which the sound-generating functional unit is the electromagnetic drive of the relay, are known. Electrical components of this type are used for example in cars. The switching noise of electrical components of this type is in many cases so loud that it can even be heard in the passenger compartment of the car. To increase driving comfort in the car, it is consequently necessary to dampen the switching noise of the relay.

A sound-dampened relay in which the terminal elements are connected to the electromagnetic drive by way of lines which have a pronounced vibration-damping effect is known. A relay of this type has the disadvantage, however, that the lines having a pronounced vibration-damping effect, which are usually made from stranded conductors or sheet-metal strips punched in a meandering shape, have an ohmic resistance which cannot be disregarded. This means that the load circuit resistance of the relay increases to a value which in some cases is no longer acceptable.

Furthermore, sound-dampened relays in which dampen elements are arranged in the holes in a header or between the header and the terminal elements, are known. These sound-dampened relays have the disadvantage that because of the sound-damping transition between the terminal element and the header, the terminal elements have only a low level of mechanical strength in the header. Thus, sound-dampened relays of this type cannot be used for plug relays, that is to say relays which are plugged into a socket together with other electronic components.

SUMMARY OF THE INVENTION

It is therefore the object of the present invention to provide an electrical component which is sound-dampened, in which there is no occurrence of increased electrical resistance in the load circuit and in which the terminal elements have sufficient mechanical strength for the electrical component to be used in plug sockets.

This object is achieved in accordance with the invention by an electrical component according to claim 1. Advantageous embodiments of the invention and processes for manufacturing the invention can be found in the additional claims.

The invention specifies an electrical component on a functional unit which is secured to a header and which generates or is sensitive to sound. Mechanically secured to the header are terminal elements which are electrically and acoustically coupled to the functional unit. The terminal elements project through holes in the header onto the side of the header remote from the functional unit. The terminal elements have a modulus of elasticity of $E_A>50$ megapascals, and are partially encased in a viskoelastic material having a modulus of elasticity of $E_W<10$ megapascals. A viskoelastic material should be understood to mean a material which can be plastically deformed and is elastic enough to return to its original shape again slowly after the deformation. The material is viskoelastic.

As a result of the encasing of the terminal elements, in accordance with the invention, in a viskoelastic material, effective dampening of the sound transmitted by or to the functional unit by way of the terminal elements is achieved. The solution according to the invention makes use of the effect that when sound is transmitted between two different materials shear stress losses of the vibrational energy occur. These losses are larger the greater the difference in the moduli of elasticity of the materials concerned.

Particularly advantageously, the terminal elements are made from a copper alloy or a similar material. These materials have a modulus of elasticity which is greater than 100 megapascals. For the viskoelastic material, a casting compound of one-component or two-component synthetic material is possible. A viskoelastic material of this type typically has a modulus of elasticity which is smaller than one megapascal. Furthermore, and also according to the invention, a viskoelastic material which is a thermoplastic is possible. Furthermore, a component in which a viskoelastic thermoplastic is partially moulded around the terminal elements is particularly advantageous. This means that the components are particularly easy and inexpensive to make.

Moreover, a component in which the terminal elements are arranged in troughs formed by the header, with part sections provided for the encasing, is particularly advantageous. In this case, the volume contained between an inner wall of the trough and the corresponding terminal element is at least partially filled with viskoelastic material. As a result of constructing the header in the form of one or more troughs, in accordance with the invention, the component is easy to manufacture with the aid of liquid viskoelastic material, which is poured into the trough and then cured. In particular, the viskoelastic material is then only located at the points provided for the encasing.

As the functional unit, for example the magnet system of an electromagnetic relay is possible. The reduced switching noise of an electromagnetic relay of this type is particularly critical when it is used in motor vehicles, where the invention is used particularly advantageously.

Furthermore, the invention discloses a process for manufacturing a component in which a viskoelastic thermoplastic is moulded partially around the terminal elements.

As a result of moulding a viskoelastic thermoplastic around the terminal elements, in accordance with the invention, the component is particularly easy and inexpensive to make.

Furthermore, the invention discloses a process for manufacturing a component, where a viskoelastic material in the liquid state is poured into a trough containing a terminal element and then cured.

As a result of manufacturing the component with the aid of a viskoelastic material poured into a trough in the liquid state, in accordance with the invention, the component is particularly easy and inexpensive to make.

Moreover, the invention discloses a process for manufacturing a component, having the following steps:

a) introducing a viskoelastic material in the solid state into a trough containing a terminal element, b) heating the viskoelastic material until it liquefies, and c) cooling the viskoelastic material until it solidifies.

As a result of manufacturing the component with the aid of a viskoelastic material which is introduced into a trough in the solid state, in accordance with the invention, soiling of the regions adjacent to the trough is largely avoided, since it is much easier to apply the viskoelastic material with precise positioning in the solid state than in the liquid state.

DETAILED DESCRIPTION OF THE PREFERRED EMBODIMENT

Figure 1:
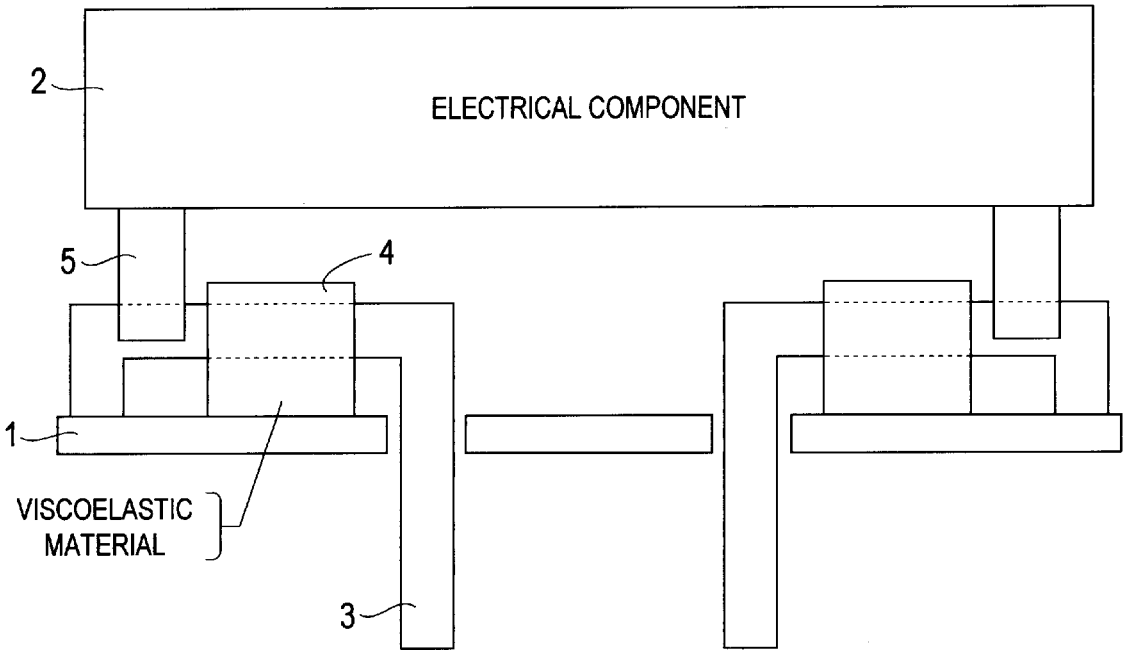
FIG. 1 hows an electrical component according to the invention, in diagrammatic cross-section.

FIG. 1 shows an electrical component having a header 1 and a functional unit 2. The header 1 may be for example of synthetic material. The functional unit 2 may be for example the electromagnetic drive system of a relay. Through a hole in the header 1 there projects a terminal element 3 which is secured to the header 1 for example by adhesion. A section of the terminal element 3 is encased in a viskoelastic material 4. The functional unit 2 is electrically and acoustically coupled to the terminal element 3 by means of a coupling element 5.

Figure 2:
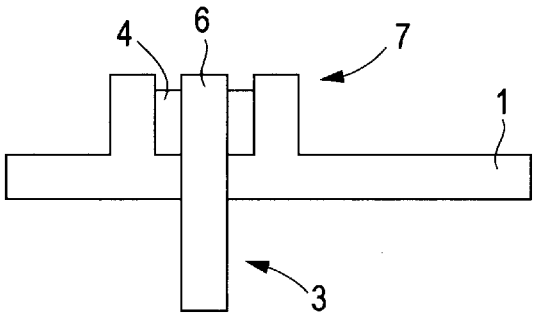
FIG. 2 shows the header, forming a trough, of an electrical component with a terminal element arranged therein, in diagrammatic cross-section.

FIG. 2 shows a header 1 which is constructed to form a trough 7. A section 6 of the terminal element 3 is located in the trough 7 and projects through the header 1 onto the side of the header 1 opposite the trough 7. The functional unit (not illustrated in FIG. 2) is located on the same side of the header 1 as the trough 7. Viskoelastic material 4 may be put into the trough 7, for example in liquid form, and subsequently cured.

The invention is not restricted to the embodiments by way of example, but is defined in its most general form in claim 1.

We claim:

1. An electrical component comprising:

a functional unit having a magnet system secured to a header;

terminal elements mechanically secured to the header that project through holes in the header onto a side of the header remote from the functional unit;

a coupling element connecting the terminal elements to the functional unit; and the terminal elements having a modulus of elasticity greater than 50 MPa and partially encased in a viscoelastic material having a modulus of elasticity less than 10 MPa.

2. An electrical component according to claim 1, in which the modulus of elasticity of the terminal elements is greater than 100 MPa and the modulus of elasticity of the viscoelastic material is less than 1 MPa.

3. An electrical component according to claim 2, in which the viskoelastic material is a casting compound of one-component or two-component synthetic material.

4. An electrical component according to claim 2, in which the viskoelastic material is a thermoplastic.

5. An electrical component according to claim 4, in which a viskoelastic thermoplastic is partially moulded around the terminal elements.

6. An electrical component according to claim 2, in which the terminal elements are arranged in troughs formed by the header, with part sections, and in which the volume contained between an inner wall of the trough and the corresponding terminal element is at least partially filled with viskoelastic material.

7. An electrical component according to claim 1, in which the functional unit is the magnet system of an electromagnetic relay.

* * * * *